US008857935B2

(12) United States Patent
Endo et al.

(10) Patent No.: US 8,857,935 B2
(45) Date of Patent: Oct. 14, 2014

(54) LIQUID EJECTING APPARATUS AND LIQUID EJECTING METHOD

(71) Applicant: Seiko Epson Corporation, Tokyo (JP)

(72) Inventors: Hironori Endo, Okaya (JP); Toshihisa Saruta, Matsumoto (JP); Toru Matsuyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/051,329

(22) Filed: Oct. 10, 2013

(65) Prior Publication Data

US 2014/0098148 A1 Apr. 10, 2014

(30) Foreign Application Priority Data

Oct. 10, 2012 (JP) ..... 2012-224648

(51) Int. Cl.
*B41J 29/38* (2006.01)

(52) U.S. Cl.
USPC ..... 347/10; 347/9; 347/11

(58) Field of Classification Search
USPC ..... 347/5, 9, 10, 11, 12
See application file for complete search history.

(56) References Cited

U.S. PATENT DOCUMENTS

| | | | | |
|---|---|---|---|---|
| 6,339,342 | B1 | 1/2002 | Yoshizawa | |
| 6,764,152 | B2 * | 7/2004 | Umeda et al. | 347/9 |
| 6,890,046 | B1 * | 5/2005 | Fukano et al. | 347/10 |
| 7,758,140 | B2 * | 7/2010 | Oshima et al. | 347/10 |

FOREIGN PATENT DOCUMENTS

| | | | |
|---|---|---|---|
| JP | 2000-269436 | A | 9/2000 |
| JP | 2003-037173 | A | 2/2003 |
| JP | 2010-114711 | A | 5/2010 |

* cited by examiner

*Primary Examiner* — Lam S Nguyen
(74) *Attorney, Agent, or Firm* — Kilpatrick Townsend & Stockton LLP

(57) ABSTRACT

A liquid ejecting apparatus includes a reference drive signal generation section that generates a reference drive signal, a signal modulation section that modulates the reference drive signal to generate a modulation reference drive signal, a signal amplification section that amplifies the modulation reference drive signal using switching elements to generate a modulation drive signal, a signal conversion section that converts the modulation drive signal to a drive signal, a piezoelectric element that deforms in response to the drive signal, a pressure chamber that expands or contracts due to the deformation of the piezoelectric element, and a nozzle opening portion that communicates with the pressure chamber. A period of alternating current components contained in the modulation drive signal are shorter than a duration of a maximum voltage or a minimum voltage, and is longer than a total time of turn-on delay times and turn-off delay times of the switching elements.

9 Claims, 8 Drawing Sheets

LIQUID EJECTING APPARATUS AND LIQUID EJECTING METHOD

BACKGROUND

1. Technical Field

The present invention relates to a liquid ejecting apparatus and a liquid ejecting method.

2. Related Art

An ink jet printer is widely used, which ejects ink on a print medium from a plurality of nozzles provided in a print head so as to record text and images. In such an ink jet printer, a predetermined amount of ink is ejected from the nozzles at a predetermined timing by a piezoelectric elements, each of which is provided in a location corresponding to each nozzle of the print head, being driven in response to a drive signal.

For example, the drive signal is generated by the following procedure. A digital modulation reference drive signal is generated by pulse-modulating an analog reference drive signal using a Pulse Width Modulation (PWM) method, a Pulse Density Modulation (PDM) method, Pulse Amplitude Modulation (PAM) method, or the like. Then, the modulation reference drive signal is amplified to generate a modulation drive signal, and the modulation drive signal is converted into a drive signal, which is an analog signal, by smoothing the modulation drive signal (for example, see JP-A-2010-114711).

In the ink jet printer of the related art, described above, there is a room for improvement in terms of ink ejection stability and suppression of power consumption.

In addition, such a problem is not limited to the ink jet printer, but may occur similarly in a liquid ejecting apparatus which ejects a liquid in response to the drive signal.

SUMMARY

The invention can be realized in the following forms.

1. According to a first aspect of the invention, there is provided a liquid ejecting apparatus. The liquid ejecting apparatus includes: a reference drive signal generation section that generates a reference drive signal;

a signal modulation section that modulates the reference drive signal to generate a modulation reference drive signal; a signal amplification section that amplifies the modulation reference drive signal using switching elements to generate a modulation drive signal; a signal conversion section that converts the modulation drive signal to a drive signal; a piezoelectric element that deforms in response to the drive signal; a pressure chamber that expands or contracts due to the deformation of the piezoelectric element; and a nozzle opening portion that communicates with the pressure chamber, in which periods of alternating current components contained in the modulation drive signal are shorter than a duration of a maximum voltage or a minimum voltage contained in the reference drive signal, and are longer than a total time of turn-on delay times and turn-off delay times of the switching elements. In this case, it is possible to suppress decrease in the ejection stability of the liquid due to decrease in waveform reproducibility of the drive signal, and to suppress increase in power consumption due to switching losses.

2. It is preferable that the signal modulation section input the reference drive signal and a comparison signal to a voltage comparator to generate the modulation reference drive signal, the comparison signal being configured by a triangular wave or a saw-tooth wave in which a single waveform is repeated, and frequencies of the alternating current components contained in the modulation drive signal be equal to a frequency of the comparison signal. In this case, the reference drive signal and the comparison signal configured by a triangular wave or a saw-tooth wave in which a single waveform is repeated are input to the voltage comparator, so that when the signal modulation section that generates the modulation reference drive signal is used, it is possible to suppress decrease in the ejection stability of the liquid due to decrease in waveform reproducibility of the drive signal, and to suppress increase in power consumption due to switching losses.

3. It is preferable that the signal modulation section input the reference drive signal and a comparison signal to a voltage comparator to generate the modulation reference drive signal, the comparison signal being configured by a triangular wave or a saw-tooth wave of which a frequency varies depending on a voltage of the reference drive signal, alternating current components of a plurality of frequencies be contained in the modulation drive signal, and among frequencies of the alternating current components contained in the modulation drive signal, a period corresponding to a maximum frequency be longer than the total time and a period corresponding to a minimum frequency is shorter than the duration. In this case, the reference drive signal and the comparison signal configured by a triangular wave or a saw-tooth wave of which the frequency varies depending on the voltage of the reference drive signal are input to the voltage comparator, so that when the signal modulation section that generates the modulation reference drive signal is used, it is possible to suppress decrease in the ejection stability of the liquid due to decrease in waveform reproducibility of the drive signal, and to suppress increase in power consumption due to switching losses.

4. It is preferable that the signal modulation section generate the modulation reference drive signal by pulsing the amplitude of the reference drive signal at a predetermined sampling frequency, and frequencies of the alternating current components contained in the modulation drive signal be equal to the sampling frequency. In this case, when the signal modulation section that generates the modulation reference drive signal by pulsing the amplitude of the reference drive signal at a predetermined sampling frequency is used, it is possible to suppress decrease in the ejection stability of the liquid due to decrease in waveform reproducibility of the drive signal, and to suppress increase in power consumption due to switching losses.

5. It is preferable that a period of the drive signal be approximately equal to an integer multiple of a natural vibration period of the pressure chamber. In this case, it is possible to suppress decrease in the ejection stability of the liquid due to variation in each period of the drive signal.

6. It is preferable that among alternating current components contained in the modulation drive signal, a frequency of an alternating current component which is most frequently contained be approximately equal to an integer multiple of a natural vibration frequency of the piezoelectric element. In this case, it is possible to improve the response property of the piezoelectric element.

7. It is preferable that the piezoelectric element transit to a normal state in which a predetermined voltage is applied, an expansion state causing the volume of the pressure chamber to expand, an expansion holding state causing the expanded volume of the pressure chamber to be kept, a contraction state causing the volume of the pressure chamber to contract, and a contraction hold state causing the contracted volume of the pressure chamber to be kept, in the order, so as to eject droplets from the nozzle opening portion, and a sum of the periods of the alternating current components contained in the modulation drive signal used for application of the drive signal to the piezoelectric element in the contracted state and the contraction hold state be approximately equal to the natural vibration period of the pressure chamber. In this case, it is possible to improve the ejection stability of the liquid.

Further, the invention can be realized in various forms, for example, in forms of a liquid ejecting apparatus, a liquid ejecting method, a method of controlling a liquid ejecting apparatus, a drive circuit for a liquid ejecting apparatus, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. Exemplary Embodiment

Figure 1:
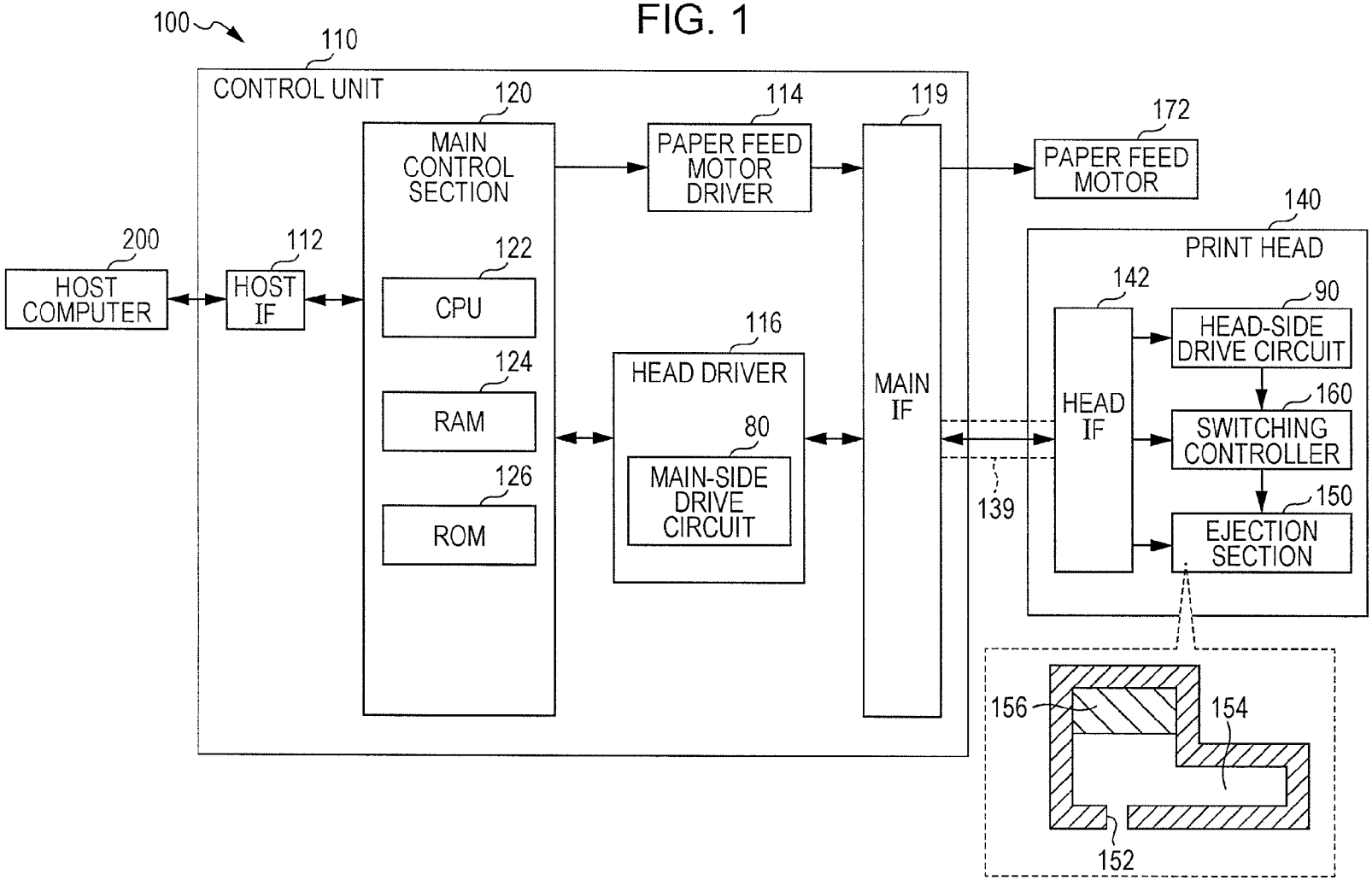
FIG. 1 is an explanatory diagram illustrating a schematic configuration of a print device in an exemplary embodiment of the invention.

FIG. 1 is an explanatory diagram illustrating a schematic configuration of a print device 100 in an exemplary embodiment of the invention. The print device 100 of the present exemplary embodiment is an ink jet printer which ejects liquid ink to form an ink dot group on a print medium, and thus prints images (including characters, graphics, and the like) in response to image data supplied from a host computer 200.

The print device 100 includes a print head 140, and a control unit 110 connected to the print head 140 through a flexible flat cable 139. The control unit 110 includes a host interface (IF) 112 for inputting image data and the like from a host computer 200, a main control section 120 that performs a predetermined arithmetic processing of printing images on the basis of image data that is input from the host interface 112, a paper feed motor driver 114 which drives and controls a paper feed motor 172 for the transport of the print media, a head driver 116 which drives and controls the print head 140, and a main interface (IF) 119 which connects respective drivers 114 and 116 with the paper feed motor 172 and the print head 140. The head driver 116 includes a main side drive circuit 80.

The main control section 120 includes a CPU 122 for executing various types of arithmetic processing, a RAM 124 for temporarily storing and developing programs and data, and a ROM 126 for storing programs executed by the CPU 122. The CPU 122 reads the programs, which are stored in the ROM 126, on the RAM 124 and executes the programs so as to realize various functions of the main control section 120. In addition, the main control section 120 may include electrical circuits, and thus a part of functions of the main control section 120 may be realized by the operation of the electrical circuits included in the main control section 120 on the basis of a configuration of the circuit.

If the main control section 120 acquires image data from the host computer 200 through the host interface 112, the main control section 120 performs an arithmetic processing of performing printing such as an image development processing, a color conversion processing, an ink color separation processing, and a halftone processing on the basis of the image data, so as to generate nozzle selection data (drive signal selection data) for defining which nozzle of the print head 140 the ink is ejected from, or the amount of ink to be ejected, and to output control signals to respective drivers 114 and 116 on the basis of the drive signal selection data. In addition, since the content of each processing of performing printing that is performed by the main control section 120 is a matter well known in the art of a print device, the description thereof is omitted here. The respective drivers 114 and 116 output signals for controlling the operation of the paper feed motor 172 and the operation of print head 140, respectively. For example, the head driver 116 supplies the print head 140 with a reference clock signal SCK, a latch signal LAT, a drive signal selection signal SI&SP, and a channel signal CH, which will be described later.

Ink of one or a plurality of colors is supplied to the print head 140 from one or a plurality of ink containers, not shown. The print head 140 includes a head interface (IF) 142, a head-side drive circuit 90, a switching controller 160, and an ejection section 150. The head-side drive circuit 90 and the switching controller 160 operate on the basis of various signals which are input from the control unit 110 through the head interface 142. The ejection section 150 includes a plurality of nozzle opening portions 152 that eject ink, and a plurality of piezoelectric elements 156 provided corresponding to a plurality of nozzle opening portion 152. In the exemplary embodiment, a piezoelectric element is used as the piezoelectric element 156. The nozzle opening portion 152 communicates with a pressure chamber 154 to which ink is supplied. The piezoelectric element 156 varies depending on a drive signal COM (described later) supplied through the head-side drive circuit 90 and the switching controller 160, and thus the pressure chamber 154 is caused to be expanded or reduced. If a pressure change occurs in the pressure chamber 154 due to the expansion or the reduction of the pressure chamber 154, the ink is ejected from the corresponding nozzle opening portion 152 due to the pressure change. It is possible to adjust the ejection amount (that is, size of a dot to be formed) of the ink by adjusting the wave height and the slope of voltage increase and decrease of the drive signal COM used to drive the piezoelectric element 156.

Figure 2A:
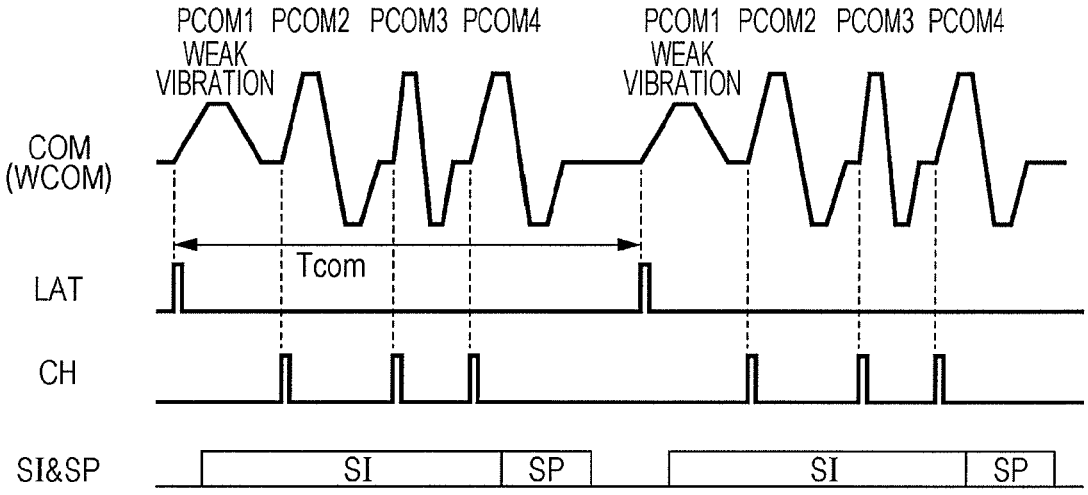
FIGS. 2A and 2B are explanatory diagrams illustrating examples of various signals used in the print head.
Figure 2B:
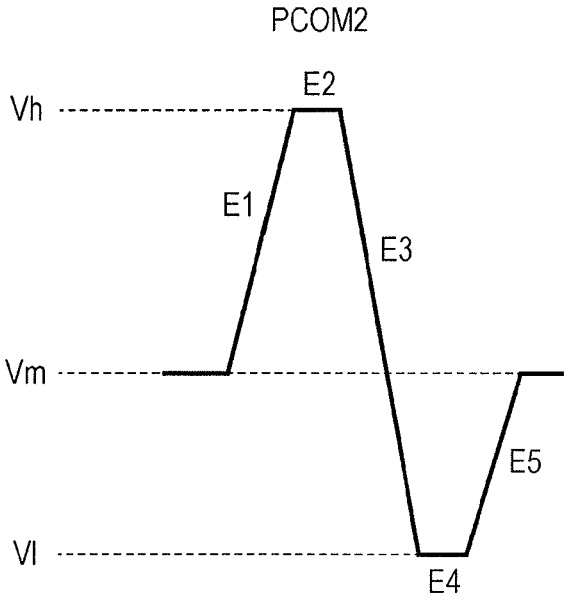

FIGS. 2A and 2B are explanatory diagrams illustrating examples of various signals used in the print head 140. FIG. 2A illustrates examples of a drive signal COM, a latch signal LAT, a channel signal CH, and a drive signal selection signal SI&SP. The drive signal COM is a signal for driving the piezoelectric element 156 provided in the ejection section 150 of the print head 140. The drive signal COM is a signal in which drive pulses PCOMs (drive pulses PCOM1 to PCOM4) are continuous in time series. The PCOM is a minimum unit (minimum drive signal) of the drive signal for driving the piezoelectric element 156. A set of four drive pulses PCOMs, which are drive pulses PCOM1, PCOM2, PCOM3 and PCOM4 that are included in each period Tcom of the drive signal COM, correspond to a pixel (print pixel).

FIG. 2B illustrates an enlarged example of the drive pulse PCOM2. The drive pulse PCOM2 is configured by an expansion component E1, an expansion holding component E2, an ejection component E3, a contraction holding component E4, and a damping control component E5. The same is applied even to the drive pulses PCOM3 and PCOM4. The expansion component E1 of each drive pulse PCOM is a component for drawing ink (also referred to as drawing a meniscus in consideration of an ink ejection surface) by the volume of the pressure chamber 154 being expanded due to the deformation of the piezoelectric element 156 that is caused by raising an electric potential from an intermediate potential VM corresponding to a normal state of the piezoelectric element 156 to an expansion potential (maximum voltage) Vh. The expansion holding component E2 is a component for holding the expansion potential Vh so as to maintain the expanded state of the pressure chamber 154. The ejection component E3 is a component (also referred to as pushing a meniscus in consideration of an ink ejection surface) for pushing the ink by the volume of the pressure chamber 154 being contracted due to the deformation of the piezoelectric element 156 that is caused by lowering an electric potential from the expansion potential Vh to a contraction potential (minimum voltage) V1. The contraction holding component E4 is a component for holding the contraction potential V1 so as to maintain the contracted state of the pressure chamber 154. The damping control component E5 is a component (also referred to as suppressing the damping of the meniscus in consideration of an ink ejection surface) for returning the volume of the pressure chamber 154 to the normal state by raising the electric potential from the contraction potential V1 to the intermediate potential Vm so as to return the piezoelectric element 156 to the normal state. Depending on each section of each drive pulse PCOM, the piezoelectric element 156 transits to a normal state, an expansion state for causing the volume of the pressure chamber 154 to expand, an expansion holding state for causing the expanded volume of the pressure chamber 154 to be kept, a contraction state for causing the volume of the pressure chamber 154 to contract, a contraction hold state for causing the contracted volume of the pressure chamber 154 to be kept, and a damping control state for causing the volume of the pressure chamber 154 to return to the normal state, in the order listed. One or a plurality of drive pulses PCOM is selected among drive pulses PCOM2, PCOM3 and PCOM4 and supplied to the piezoelectric element 156, so that it is possible to form ink dots of various sizes. In addition, in the exemplary embodiment, a drive pulse PCOM1 called weak vibration is included in the drive signal COM. The drive pulse PCOM1 is used in a case where the ink is drawn in but is not pushed out, for example, in a case where the thickening of the nozzle opening portions 152 is suppressed. In addition, as will described later, since the drive signal COM is generated by amplifying the reference drive signal WCOM, the signal waveform of the reference drive signal WCOM is the same as the waveform of the drive signal COM illustrated in FIG. 2A.

The drive signal selection signal SI&SP is a signal to select a nozzle opening portion 152 for ejecting the ink and to determine timing at which the piezoelectric element 156 is connected to the drive signal COM. The latch signal LAT and the channel signal CH are signals to connect the drive signal COM to the piezoelectric element 156 of the print head 140, on the basis of the drive signal selection signal SI&SP, after nozzle selection data for all nozzle opening portions 152 is input. As illustrated in FIG. 2A, the latch signal LAT and the channel signal CH are signals which are in synchronous with the drive signal COM. In other words, the latch signal LAT is a signal which becomes a high level in accordance with the start timing of the drive signal COM, and the channel signal CH is a signal which becomes a high level in accordance with the start timing of each drive pulse PCOM constituting the drive signal COM. The outputs of a series of drive signals COM are started in response to the latch signal LAT, and each drive pulse PCOM is output in response to the channel signal CH. Further, a reference clock signal SCK is a signal for transferring the drive signal selection signal SI&SP as a serial signal to the print head 140. In other words, the reference clock signal SCK is a signal used to determine timing at which ink is ejected from the nozzle opening portion 152 of the print head 140.

Figure 3:
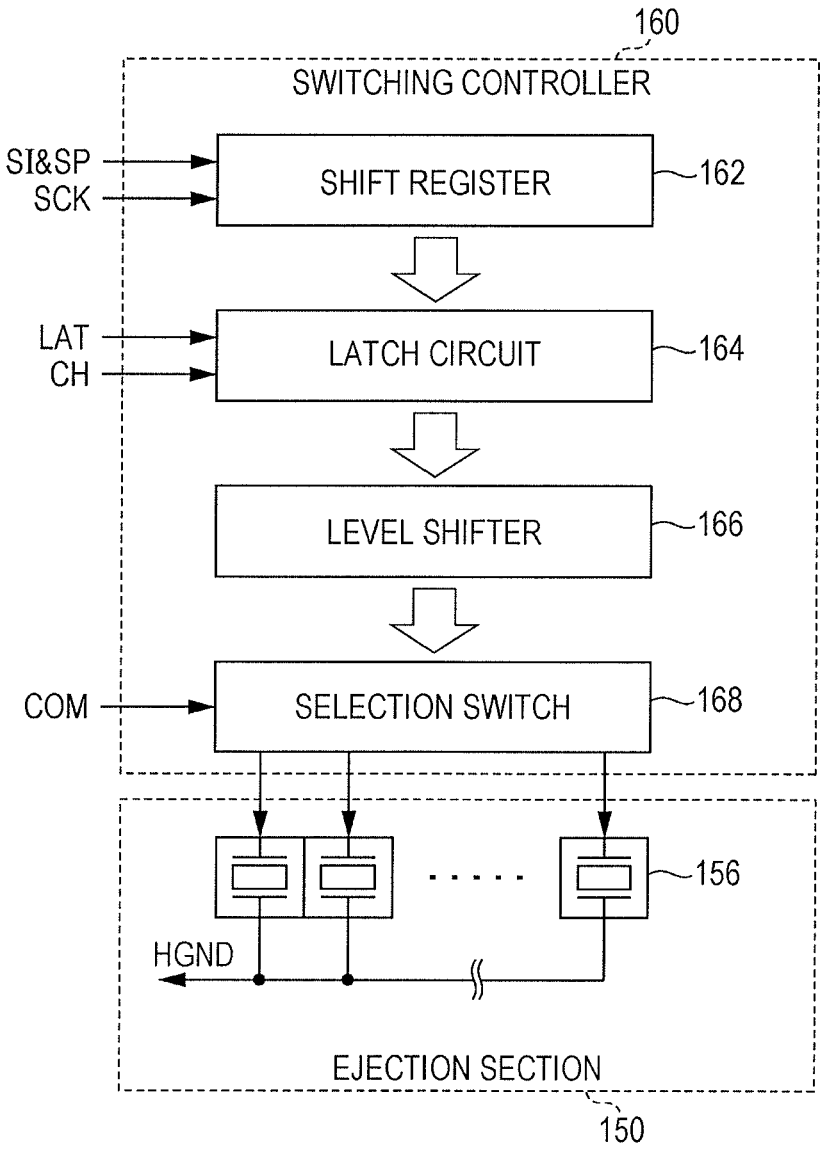
FIG. 3 is an explanatory diagram illustrating a configuration of a switching controller of the print head.

FIG. 3 is an explanatory diagram illustrating a configuration of a switching controller 160 (see FIG. 1) of the print head 140. The switching controller 160 selectively supplies the drive signal COM to the piezoelectric element 156. The switching controller 160 includes a shift register 162 that saves the drive signal selection signal SI&SP, a latch circuit 164 that temporarily saves data of the shift register 162, a level shifter 166 that level-converts the output of the latch circuit 164 and supplies the changed output to the selection switch 168, and a selection switch 168 that connects the drive signal COM to the piezoelectric element 156.

The drive signal selection signal SI&SP is sequentially input to the shift register 162, and thus a region, to which data is stored, is sequentially shifted to the subsequent stage in response to the input pulse of the reference clock signal SCK. After the drive signal selection signals SI&SP of the number of nozzles are stored in the shift register 162, the latch circuit 164 latches each output signal of the shift register 162 in response to the latch signal LAT to be input. The signal saved in the latch circuit 164 is converted to a voltage level, at which the selection switch 168 of the subsequent stage can be switched (ON/OFF), by the level shifter 166. The piezoelectric element 156 corresponding to the selection switch 168 to be closed (becomes a connection state) by the output signal of the level shifter 166 is connected to the drive signal COM (drive pulses PCOM) at the connection timing of the drive signal selection signal SI&SP. Thus, the piezoelectric element 156 is changed, and the ink of the amount in response to the drive signal COM is ejected from the nozzle. Further, after the drive signal selection signal SI&SP which is input to the shift register 162 is latched to the latch circuit 164, a subsequent drive signal selection signal SI&SP is input to the shift register 162 and data saved in the latch circuit 164 is sequentially updated in accordance with the ejection timing of the ink. According to the selection switch 168, even after the piezoelectric element 156 is separated from the drive signal COM (drive pulse PCOM), an input voltage of the piezoelectric element 156 is maintained at the voltage immediately before the separation. In addition, a symbol HGND in FIG. 3 denotes a ground end of the piezoelectric element 156.

Figure 4:
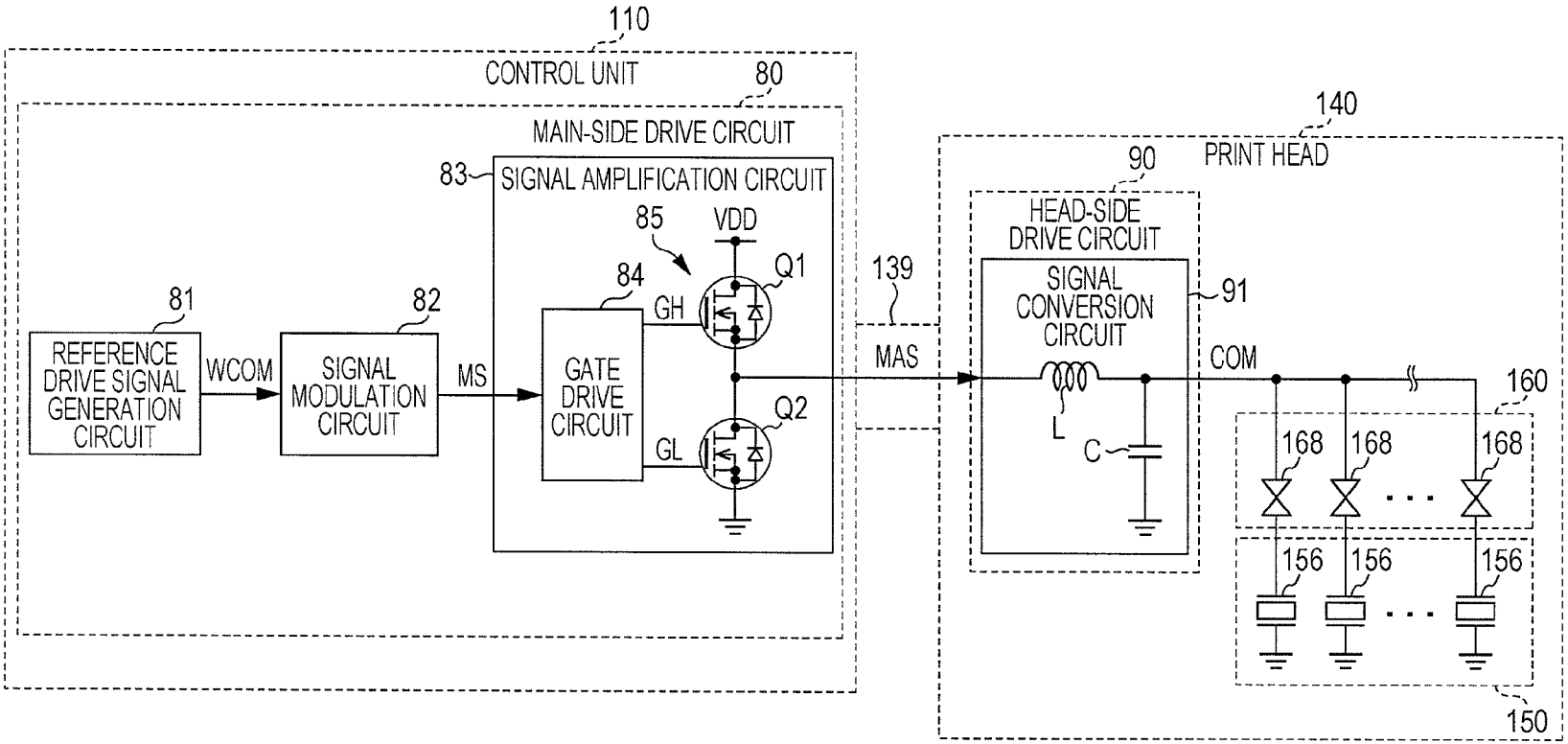
FIG. 4 is an explanatory diagram illustrating a configuration for generating a drive signal COM in the print device.

FIG. 4 is an explanatory diagram illustrating a configuration for generating a drive signal COM in the print device 100. In FIG. 4, with respect to the configurations which are not directly related to the generation of the drive signal COM out of the configurations of the print device 100, the illustration thereof are appropriately omitted. In the exemplary embodiment, the drive signal COM is generated by the main-side drive circuit 80 of the control unit 110 and the head-side drive circuit 90 of the print head 140. The main-side drive circuit 80 includes a reference drive signal generation circuit 81, a signal modulation circuit 82, and a signal amplification circuit 83. Further, the head-side drive circuit 90 includes a signal conversion circuit 91.

The reference drive signal generation circuit 81 is a circuit which generates an analog reference drive signal WCOM as a reference of the aforementioned drive signal COM. For example, as described in JP-A-2011-207234, the reference drive signal generation circuit 81 is configured to include a waveform memory for storing waveform forming data, which is input from the main control section 120, in a storage element corresponding to a predetermined address, a first latch circuit which latches the waveform forming data read from the waveform memory by a first clock signal, an adder which adds an output of the first latch circuit and waveform forming data W to be output from a second latch circuit that will be described later, a second latch circuit which latches an addition output of the adder by a second clock signal, and a D/A converter which converts the waveform forming data to be output from the second latch circuit to the reference drive signal WCOM that is an analog signal.

Figure 5A:
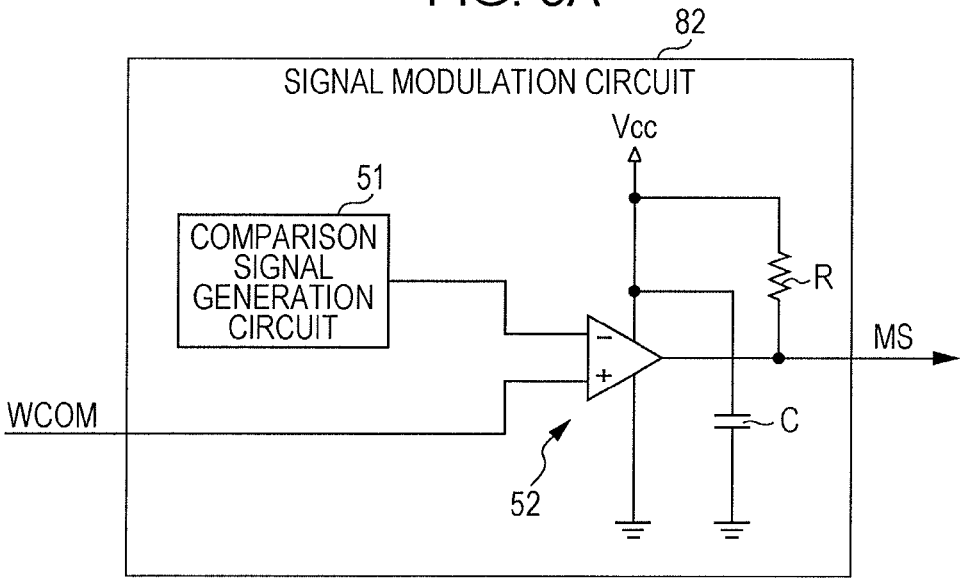
FIGS. 5A and 5B are explanatory diagrams illustrating examples of a signal modulation circuit.
Figure 5B:
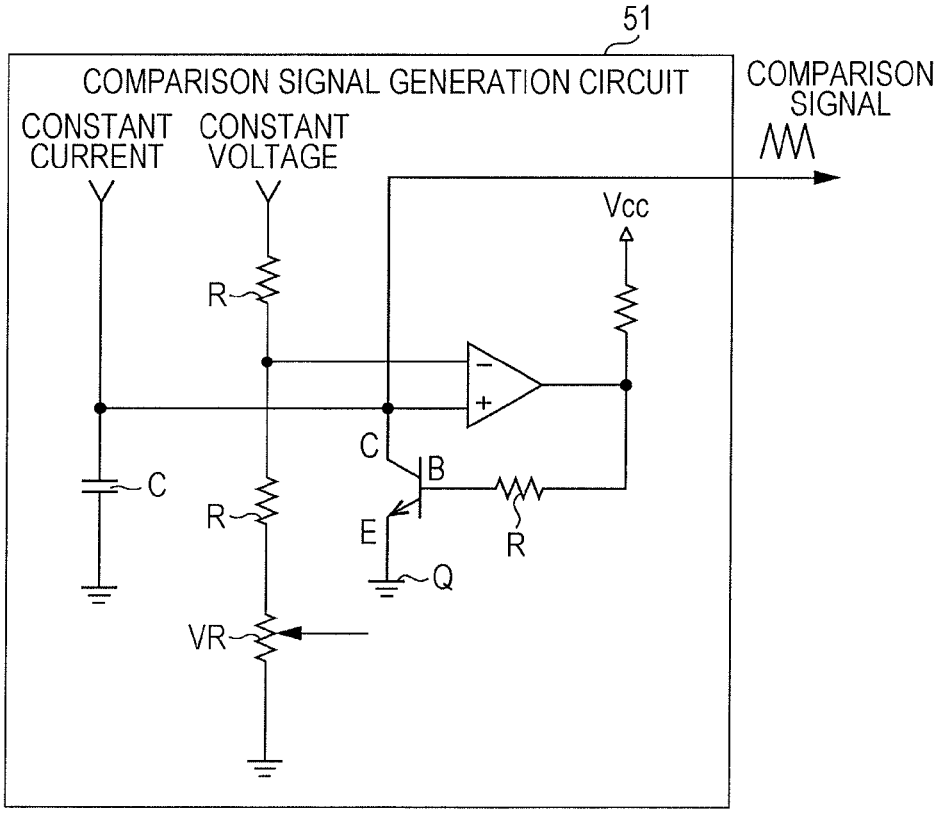

The signal modulation circuit 82 is a circuit which receives reference drive signal WCOM from the reference drive signal generation circuit 81, and generates a modulation reference drive signal MS which is a digital signal by performing a pulse modulation on the reference drive signal WCOM. The exemplary embodiment uses a pulse width modulation (PWM) as a modulation method in the signal modulation circuit 82. FIGS. 5A and 5B are explanatory diagrams illustrating examples of a signal modulation circuit 82. As illustrated in FIG. 5A, the signal modulation circuit 82 includes a comparison signal generation circuit 51 that outputs a comparison signal configured by a triangular wave (or saw-tooth wave) in which a single waveform is repeated at a predetermined frequency and a voltage comparator 52 that compares a reference drive signal WCOM with the comparison signal. FIG. 5B illustrates an example of a configuration of the comparison signal generation circuit 51. The signal modulation circuit 82 generates a modulation reference drive signal MS which is Hi when the reference drive signal WCOM is the comparison signal or more, and is Lo when the reference drive signal WCOM is less than the comparison signal.

The signal amplification circuit 83 is a circuit (a so called D class amplifier) which receives a modulation reference drive signal MS from the signal modulation circuit 82, and generates a modulation drive signal MAS by performing power amplification on the modulation reference drive signal MS. The signal amplification circuit 83 includes a half-bridge output stage 85 configured by two switching elements (a high-side switching element Q1 and a low-side switching element Q2) for substantially amplifying the power, and a gate drive circuit 84 which adjusts respective gate-source signals GH and GL of the switching elements Q1 and Q2, on the basis of the modulation reference drive signal MS from the signal modulation circuit 82. In the signal amplification circuit 83, when the modulation reference drive signal MS is high level, the gate-source signal GH becomes high level and thus the high-side switching element Q1 turns ON, but the gate-source signal GL becomes low level and thus the low-side switching element Q2 turns OFF. As a result, the output of the half-bridge output stage 85 becomes a supply voltage VDD. On the other hand, when the modulation reference drive signal MS is low level, the gate-source signal GH becomes low level, and thus high-side switching element Q1 turns OFF, but the gate-source signal GL becomes high level and thus the low-side switching element Q2 turns ON. As a result, the output of the half-bridge output stage 85 becomes zero. In this way, the signal amplification circuit 83 performs power amplification by switching operations of the high-side switching element Q1 and the low-side switching element Q2 on the basis of the modulation reference drive signal MS, and thus the modulation drive signal MAS is generated.

The signal conversion circuit 91 is a circuit (a so-called smoothing filter) which receives the modulation drive signal MAS from the signal amplification circuit 83, and generates the drive signal COM (drive pulse PCOM) which is an analog signal by smoothing the modulation drive signal MAS. In the exemplary embodiment, a low pass filter using a combination of a capacitor C and a coil L is used as the signal conversion circuit 91. The signal conversion circuit 91 attenuates modulation frequency components generated in the signal modulation circuit 82, and outputs the drive signal COM having a waveform characteristic described above. The drive signal COM generated by the signal conversion circuit 91 is supplied to the piezoelectric element 156 of the ejection section 150 through the selection switch 168 of the switching controller 160.

Here, alternating current components (also referred to as a ripple noise) derived from the pulse modulation by the signal modulation circuit 82 are contained in the modulation drive signal MAS which is output from the signal amplification circuit 83. In the exemplary embodiment, since a pulse width modulation (PWM) is used as a modulation method in the signal modulation circuit 82, the frequencies of the alternating current components contained in the modulation drive signal MAS are equal to the frequency of the comparison signal which is output from the comparison signal generation circuit 51. In other words, the periods of the alternating current components contained in the modulation drive signal MAS are equal to the period of the comparison signal which is output from the comparison signal generation circuit 51.

In the exemplary embodiment, the periods of the alternating current components contained in the modulation drive signal MAS are shorter than the duration of the maximum voltage or the minimum voltage contained in the reference drive signal WCOM, and is longer than total time of the turn-on delay times and the turn-off delay times of the switching elements Q1 and Q2 of the signal amplification circuit 83. In addition, the duration of the maximum voltage contained in the reference drive signal WCOM is the duration of the expansion holding component E2 illustrated in FIG. 2B, and the duration of the minimum voltage contained in the reference drive signal WCOM is the duration of the contraction holding component E4 illustrated in FIG. 2B. Further, the turn-on delay times and the turn-off delay times of the switching elements Q1 and Q2 are uniquely determined in accordance with the type (part number) of the switching elements to be used. In the exemplary embodiment, it is assumed that at least one of the waveform of the reference drive signal WCOM, the type of the switching elements to be used, and the period of the comparison signal to be output from the comparison signal generation circuit 51 is adjusted, such that the periods of the alternating current components contained in the modulation drive signal MAS are shorter than the duration of the maximum voltage or the minimum voltage contained in the reference drive signal WCOM, and is longer than total time of the turn-on delay times and the turn-off delay times of the switching elements Q1 and Q2.

If the duration of the maximum voltage (or minimum voltage) included in the reference drive signal WCOM is excessively short, a distortion occurs in the waveform during amplification by the signal amplification circuit 83, and thus the ejection stability of the liquid may be decreased due to decrease in waveform reproducibility of the drive signal COM. In the exemplary embodiment, since the periods of the alternating current components contained in the modulation drive signal MAS are shorter than the duration of the maximum voltage or the minimum voltage contained in the reference drive signal WCOM (that is, the duration of the maximum voltage or the minimum voltage contained in the reference drive signal WCOM is longer than the periods of the alternating current components contained in the modulation drive signal MAS), it is possible to suppress decrease in the ejection stability of the liquid due to decrease in waveform reproducibility of the drive signal COM.

Further, if the total time of the turn-on delay times and the turn-off delay times of the switching elements Q1 and Q2 of the signal amplification circuit 83 is long, switching loss increases. Especially, for example, if a plurality of nozzle opening portions 152 are provided in the print head 140 so as to realize a high-quality printing at a high-speed, the total capacitance of the print head 140 is increased due to increase in the number of the piezoelectric elements 156, and the amount of current required to drive the print head 140 is also increased, and thus, that switching loss is likely to increase. In the exemplary embodiment, since the periods of the alternating current components contained in the modulation drive signal MAS is longer than the total time of the turn-on delay times and the turn-off delay times of the switching elements Q1 and Q2 of the signal amplification circuit 83 (that is, the total time of the turn-on delay times and the turn-off delay times of the switching elements Q1 and Q2 is shorter than the periods of the alternating current components contained in the modulation drive signal MAS), it is possible to suppress the increase in power consumption due to the switching losses.

Further, in the exemplary embodiment, the period Tcom (FIG. 2A) of the drive signal COM is approximately equal to the integer multiple of the natural vibration period of the pressure chamber 154. For this reason, in the exemplary embodiment, it is possible to set a relationship between the drive signal COM and the state of ink inside the pressure chamber 154 (especially, the state of the meniscus) to be approximately equal in each period Tcom, and to suppress the decrease of the ink ejection stability due to variations in each period of the drive signal COM. In addition, the integer multiple of the natural vibration period of the pressure chamber 154 includes the natural vibration period as it is of the pressure chamber 154 (one multiple of the natural vibration period of the pressure chamber 154). Further, a fact in which the period Tcom of the drive signal COM is approximately equal to the integer multiple of the natural vibration period of the pressure chamber 154 means that the period Tcom of the drive signal COM is within the range of 90% to 110% of the integer multiple of the natural vibration period of the pressure chamber 154. For example, an input signal of a sinusoidal shape is added to the piezoelectric element 156 while changing the frequency thereof, the behavior of the meniscus in the nozzle opening portion 152 is observed using a stroboscope that emits light in synchronization with the input signal, and a frequency at which the meniscus greatly vibrates is specified, thereby allowing the natural vibration period of the pressure chamber 154 to be measured. Otherwise, the natural vibration period of the pressure chamber 154 can be measured by observing a residual vibration of the meniscus after an ink ejection by a normal driving.

Further, in the exemplary embodiment, the frequency of the alternating current component which is most frequently contained, among alternating current components contained in the modulation drive signal MAS, is approximately equal to the integer multiple of the natural vibration period of the piezoelectric element 156. Therefore, it is possible to improve the response property of the piezoelectric element 156 by the drive signal COM, in the exemplary embodiment. In addition, in the exemplary embodiment, the frequency of the alternating current component which is most frequently contained, among alternating current components contained in the modulation drive signal MAS, is equal to the frequency of the comparison signal to be output from the comparison signal generation circuit 51. The vibration state of the piezoelectric element 156 is observed using a laser displacement meter, thereby allowing the natural vibration frequency of the piezoelectric element 156 to be measured. Otherwise, the counter electromotive force generated when a voltage is applied to the piezoelectric element 156 is measured, thereby allowing the natural vibration frequency of the piezoelectric element 156 to be measured.

Further, in the exemplary embodiment, a sum of the periods of the alternating current components contained in the modulation drive signal MAS used for application of the drive signal COM to the piezoelectric element 156, in the contracted state corresponding to the ejection component E3 (FIG. 2B) of the drive signal COM and to the piezoelectric element 156 of the contraction hold state corresponding to the contraction holding component E4 of the drive signal COM is approximately equal to the natural vibration period of the pressure chamber 154. Therefore, it is possible to improve the injection stability of ink, in the exemplary embodiment.

B. Modification Example

In addition, the invention is not limited to the exemplary embodiment, the invention can be implemented in various embodiments without departing from the scope and spirit thereof, and for example, the following modifications are also possible.

Figure 6:
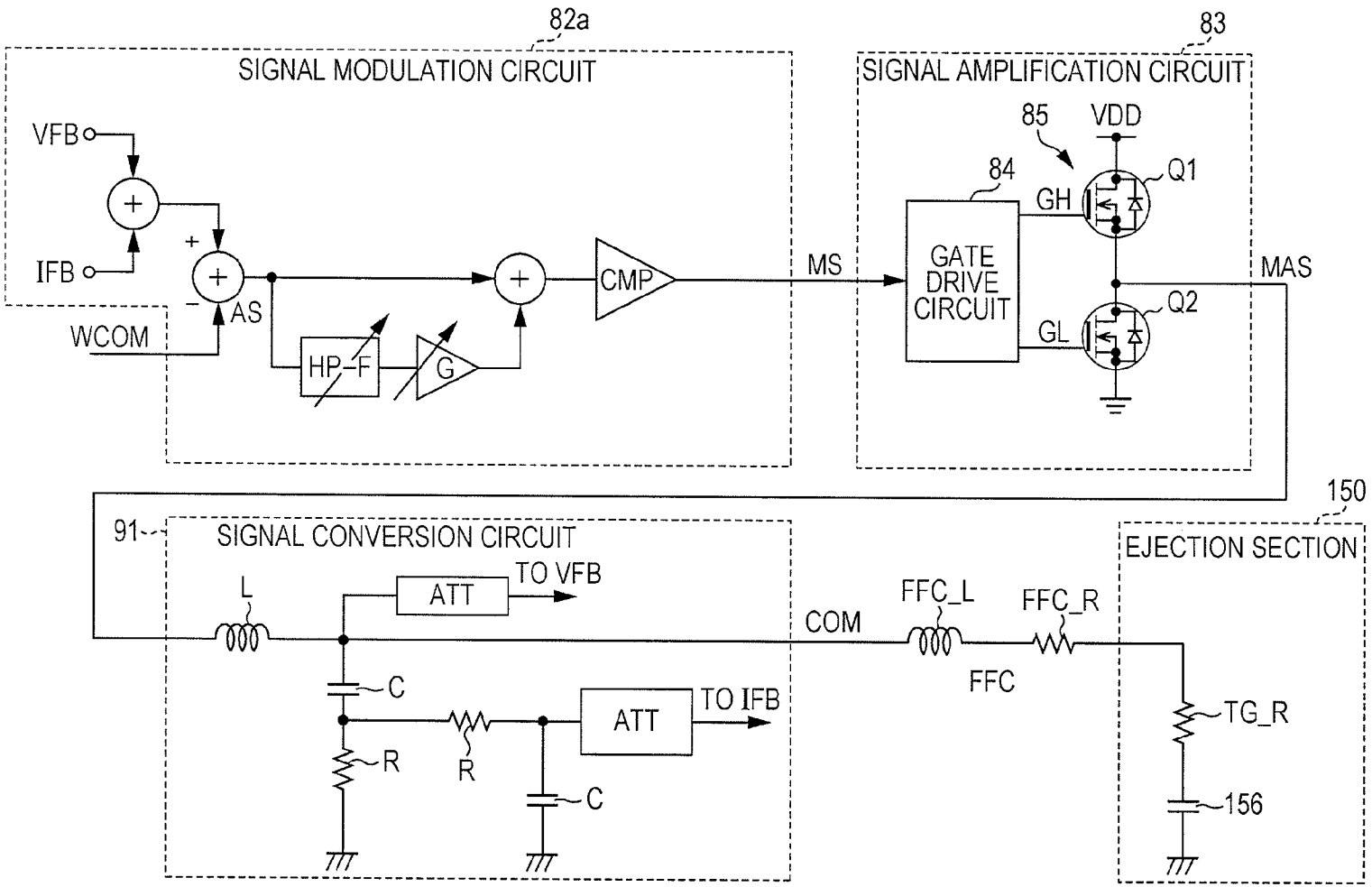
FIG. 6 is an explanatory diagram illustrating an example of a configuration of a signal modulation circuit using a pulse density modulation.

The configuration of the print device 100 in the above exemplary embodiment is merely an example, but various variations are possible. For example, a pulse width modulation (PWM) is used as a modulation method in the signal modulation circuit 82 in the exemplary embodiment, but instead thereof, a pulse density modulation (PDM) may be used. FIG. 6 is an explanatory diagram illustrating an example of a configuration of a signal modulation circuit 82*a* using a pulse density modulation. As illustrated in FIG. 6, the signal modulation circuit 82*a* inputs a reference drive signal WCOM and a comparison signal configured by a triangular wave or a saw-tooth wave of which the frequency changes according to the voltage of the reference drive signal WCOM to the voltage comparator so as to generate the modulation reference drive signal MS. In general, the pulse density modulation is performed by using a so-called ΔΣ modulation circuit which includes a comparator that compares the input signal with a predetermined value and outputs a signal that becomes a high level when the input signal is the predetermined value or more, a subtractor that calculates an error between the input signal and the output signal of the comparator, a delay device that delays the error, and an adder-subtractor that adds or subtracts the delayed error to or from the original signal. However, in the example illustrated in FIG. 6, the signal modulation circuit 82*a* using pulse density modulation does not include the delay device. A low-pass filter that is configured as the signal conversion circuit 91 is also referred to as a delay device, so that as denoted as VFB in FIG. 6, an output (COM) of a LC low pass filter instead of the delay device is used as a delay signal. Further, a circuit (high pass filter (HP-F) and high-frequency boost (G)) which emphasizes high-frequency components and a circuit (denoted as "IFB") which returns the high-frequency components are added in the modification example illustrated in FIG. 6. In other words, in this example, the signal modulation circuit 82*a* receives a modulation signal after amplification by the signal amplification circuit 83 as a return signal, and corrects the modulation reference drive signal MS to be generated. In addition, the signal modulation circuit 82*a* includes a circuit using the ΔΣ modulation circuit, but it may be configured using another circuit capable of performing a pulse density modulation.

Figure 7:
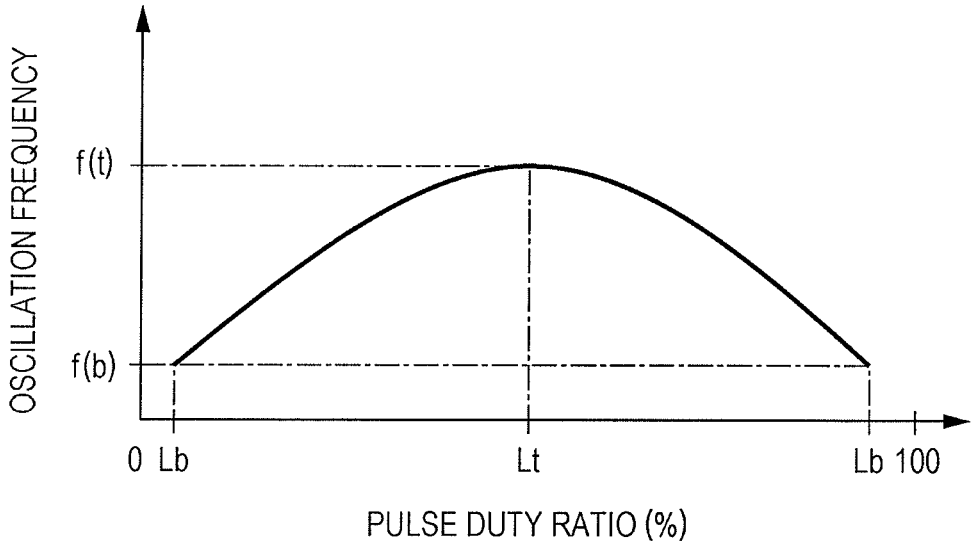
FIG. 7 is an explanatory diagram illustrating an oscillation frequency of a signal modulation circuit using a pulse density modulation.

In the signal modulation circuit 82*a* using the pulse density modulation, as illustrated in FIG. 7, the oscillation frequency varies depending on a voltage level (pulse duty ratio) of the reference drive signal WCOM. Specifically, the oscillation frequency in the signal modulation circuit 82*a* is the highest when the voltage level of the reference drive signal WCOM is an intermediate value, and it becomes low as the voltage level of the reference drive signal WCOM becomes smaller or larger than the intermediate value. In other words, the oscillation characteristic of the signal modulation circuit 82*a* is as follows. If the voltage level of the reference drive signal WCOM is in a range of a predetermined level Lt or less, the oscillation frequency is increased with the increase in the voltage level of the reference drive signal WCOM. If the voltage level of the reference drive signal WCOM is in a range of a predetermined level Lt or more, the oscillation frequency is decreased with the increase in the voltage level of the reference drive signal WCOM.

In the modification example illustrated in FIG. 6, since the frequencies of the alternating current components contained in the modulation drive signal MAS correspond to the oscillation frequency of the signal modulation circuit 82*a*, alternating current components of a plurality of frequencies are contained in the modulation drive signal MAS. In the modification example illustrated in FIG. 6, the longest period (period corresponding to a minimum frequency f(b)) among the periods of the alternating current components contained in the modulation drive signal MAS is shorter than the duration of the maximum voltage or the minimum voltage contained in the reference drive signal WCOM, the shortest period (period corresponding to a maximum frequency f(t)) among the periods of the alternating current components contained in the modulation drive signal MAS is longer than a total time of the turn-on delay times and the turn-off delay times of the switching elements Q1 and Q2 of the signal amplification circuit 83. Therefore, in the modification example illustrated in FIG. 6, similar to the above exemplary embodiment, it is possible to suppress decrease in the ejection stability of the ink due to a decrease in waveform reproducibility of the drive signal COM, and to suppress increase in power consumption due to switching losses.

Further, in the modification example illustrated in FIG. 6, since the frequency of the alternating current component which is most frequently contained, among alternating current components contained in the modulation drive signal MAS, is approximately equal to the integer multiple of the natural vibration frequency of the piezoelectric element 156, similar to the above exemplary embodiment, it is possible to improve the response property of the piezoelectric element 156 by the drive signal COM.

Figure 8:
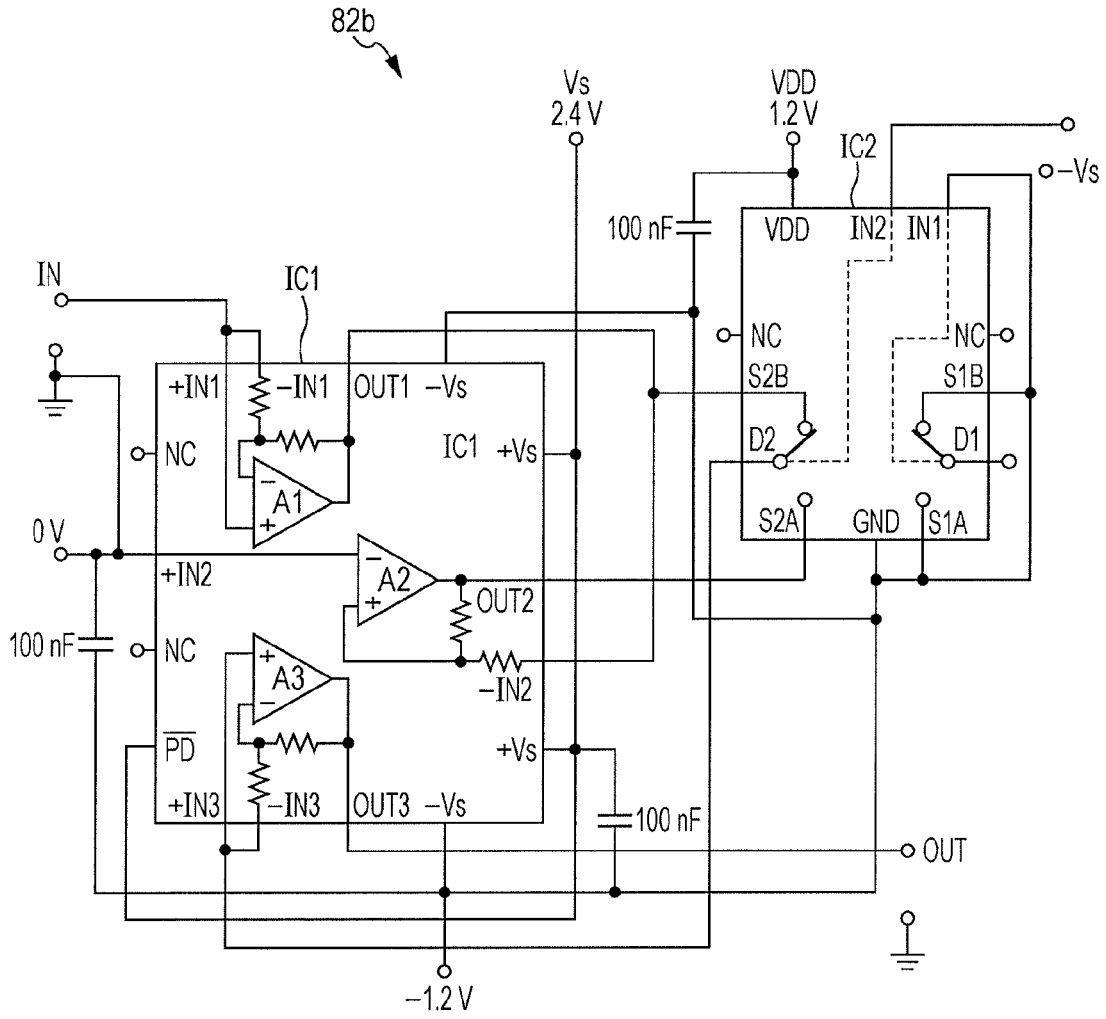
FIG. 8 is an explanatory diagram illustrating an example of a configuration of a signal modulation circuit using a pulse amplitude modulation.

Further, a pulse amplitude modulation (PAM) may be used as a modulation method in the signal modulation circuit 82. FIG. 8 is an explanatory diagram illustrating an example of a configuration of a signal modulation circuit 82*b* using a pulse amplitude modulation. As illustrated in FIG. 8, the signal modulation circuit 82*b* generates the modulation reference drive signal MS by pulsing the amplitude of reference drive signal WCOM at a predetermined sampling frequency.

Specifically, the signal modulation circuit 82*b* illustrated in FIG. 8 is configured using a video amplifier IC1 (for example, "ADA4856-3" manufactured by Analog Devices, Inc., U.S.) having three operational amplifiers (A1, A2, and A3). Two resistors are respectively connected to each of the operational amplifiers A1, A2 and A3. By the illustrated wirings, the operational amplifiers A1 and A3 function as forward amplifiers of which gain (amplification degree) is 1, and the operational amplifier A2 functions as a reward amplifier of which gain is −1. IC2 is a high-speed multiplexer of Break-Before-Make (BBM) type (for example, "ADG772" manufactured by Analog Devices, Inc., U.S.), and alternately switches a destination of a connection to the input of the operational amplifier A3 between the output of the operational amplifier A1 and the output of the operational amplifier A2. The duty cycle of a control logic signal IN2 of the IC2 is maintained close to 50%. Thus, the average value of the output voltage of the operational amplifier A3 becomes about 0V. For example, when the modulation rate, that is, the frequency of the control logic signal is about 6 MHz, the direct current component of the output voltage is only low-frequency offset voltage of an average of only 4 mV or less. Typically, both contacts S2A and S2B of the switch temporarily turn off in Break-Before-Make Time Delay (tBBM) of 5 ns. When the control frequency is 60 MHz, the period while each switch turns on is supposed to be about 8.3 ns, one half period, but actually the period during each switch turns on becomes 3.3 ns because tBBM exists. Further, if the turn-on times of the contacts S2A and S2B of the switch are different, it appears as a direct current component in the result. According to the circuit illustrated in FIG. 8, the reference drive signal WCOM is input to the input terminal IN and the modulation reference drive signal MS is generated as a pulse amplitude modulation wave in which the absolute value of the amplitude of each pulse is equal to the instantaneous voltage level of the waveform of the reference drive signal WCOM and the sign is alternately changed to positive and negative. Since the waveform of the generated modulation reference drive signal MS has an average value of about 0V, it can be easily transferred in a state being insulated by the transformer. In addition, another multiplexer which performs an operation of Make-Before-Break (MBB) type may be used as the multiplexer used in the circuit of FIG. 8. In such a type of multiplexer, a conduction period is equal to or more than three times the conduction period in FIG. 8 at the frequency of 60 MHz, the impact resulted from the difference in the turn-on times between the switches is also reduced. In addition, in a case of using the MBB type multiplexer, it is necessary to prevent the overload caused by short circuit outputs of the operational amplifiers A1 and A2 from occurring, so that it is preferable to insert a surface mount resistor (for example, substantially 20Ω) in the outputs of the operational amplifiers A1 and A2. In addition, the signal modulation circuit 82*b* may be configured using another circuit capable of performing a pulse amplitude modulation.

In the modification example illustrated in FIG. 8, the frequency of the alternating current component contained in the modulation drive signal MAS is equal to the sampling frequency. In the modification example illustrated in FIG. 8, similar to the above exemplary embodiment, since the period of the alternating current component contained in the modulation drive signal MAS is shorter than the duration of the maximum voltage or the minimum voltage contained in the reference drive signal WCOM, and longer than a total time of the turn-on delay times and the turn-off delay times of the switching elements Q1 and Q2 of the signal amplification circuit 83, it is possible to suppress decrease in the ejection stability of the ink due to decrease in waveform reproducibility of the drive signal COM, and to suppress increase in power consumption due to switching losses.

Further, in the modification example illustrated in FIG. 8, since the frequency of the alternating current component which is most frequently contained, among alternating current components contained in the modulation drive signal MAS, is approximately equal to the integer multiple of the natural vibration frequency of the piezoelectric element 156, similar to the above exemplary embodiment, it is possible to improve the response property of the piezoelectric element 156 by the drive signal COM.

Further, various signals that were exemplified in the above exemplary embodiment are merely examples, and various modifications are possible. For example, although the drive signal COM is a signal that is configured by a plurality of trapezoidal waveforms in the exemplary embodiment, the drive signal COM may be a signal that is configured by a plurality of rectangular waveforms, and may be a signal including curved waveforms.

Further, although the signal amplification circuit 83 is disposed within the main-side drive circuit 80 of the control unit 110 in the exemplary embodiment, the signal amplification circuit 83 may be disposed within the head-side drive circuit 90 of the print head 140. Further, although the signal conversion circuit 91 is disposed within the head-side drive circuit 90 of the print head 140 in the exemplary embodiment, the signal conversion circuit 91 may be disposed on the flexible flat cable 139 that connects the control unit 110 and the print head 140.

Although the print device 100 receives image data from the host computer 200 to perform a printing process in the exemplary embodiment, instead thereof, the print device 100 may perform the printing process on the basis of, for example, image data acquired from a memory card, image data acquired from a digital camera through a predetermined interface, image data acquired by a scanner, and the like. Further, the main control section 120 of the print device 100 which receives image data performs an arithmetic processing of performing printing such as an image development processing, a color conversion processing, an ink color separation processing, and a halftone processing in the exemplary embodiment, but the arithmetic processing may be performed by the host computer 200. In this case, the print device 100 receives a print command generated using the arithmetic processing by the host computer 200, and performs a print processing according to the print command. Further, the invention is applicable to a serial printer in which a carriage for mounting the print head 140 is reciprocated during printing, and is also applicable to a line printer without being involved in such reciprocation. Further, the invention is also applicable to an on-carriage type printer in which an ink cartridge is reciprocated along with a carriage, and is also applicable to an off-carriage type printer in which the holder for mounting an ink cartridge is provided in a location other than a carriage, and ink is supplied from the ink cartridge to a print head 140 through a flexible tube or the like. Further, the invention is also applicable to a print device which forms an image on print media with a liquid (including the fluid-like material such as a liquid body or a gel in which particles of functional materials are dispersed) other than ink.

Further, a part of the configuration realized by hardware in the exemplary embodiment may be replaced by software, on the contrary, a part of the configuration realized by software in the exemplary embodiment may be replaced by hardware. Further, in a case where all or a part of functions of the invention is realized by software, the software (computer program) can be provided in a form stored on a computer readable recording medium. In the invention, "computer readable recording medium" is not limited to a portable recording medium such as a flexible disk and a CD-ROM, but includes an internal storage device, installed in a computer, such as various ROMs and RAMs, and an external storage device, fixed to the computer, such as a hard disk, or the like.

The entire disclosure of Japanese Patent Application No. 2012-224648, filed Oct. 10, 2012 is expressly incorporated by reference herein.

What is claimed is:

1. A liquid ejecting apparatus comprising:

a reference drive signal generation section that generates a reference drive signal;

a signal modulation section that modulates the reference drive signal to generate a modulation reference drive signal;

a signal amplification section that amplifies the modulation reference drive signal using switching elements to generate a modulation drive signal;

a signal conversion section that converts the modulation drive signal to a drive signal;

a piezoelectric element that deforms in response to the drive signal;

a pressure chamber that expands or contracts due to the deformation of the piezoelectric element; and a nozzle opening portion that communicates with the pressure chamber, wherein periods of alternating current components contained in the modulation drive signal are shorter than a duration of a maximum voltage or a minimum voltage contained in the reference drive signal, and are longer than a total time of turn-on delay times and turn-off delay times of the switching elements.

2. The liquid ejecting apparatus according to claim 1, wherein the signal modulation section inputs the reference drive signal and a comparison signal to a voltage comparator to generate the modulation reference drive signal, the comparison signal being configured by a triangular wave or a saw-tooth wave in which a single waveform is repeated, and wherein frequencies of the alternating current components contained in the modulation drive signal are equal to a frequency of the comparison signal.

3. The liquid ejecting apparatus according to claim 1, wherein the signal modulation section inputs the reference drive signal and a comparison signal to a voltage comparator to generate the modulation reference drive signal, the comparison signal being configured by a triangular wave or a saw-tooth wave of which a frequency varies depending on a voltage of the reference drive signal, wherein alternating current components of a plurality of frequencies are contained in the modulation drive signal, and wherein among frequencies of the alternating current components contained in the modulation drive signal, a period corresponding to a maximum frequency is longer than the total time and a period corresponding to a minimum frequency is shorter than the duration.

4. The liquid ejecting apparatus according to claim 1, wherein the signal modulation section generates the modulation reference drive signal by pulsing the amplitude of the reference drive signal at a predetermined sampling frequency, and wherein frequencies of the alternating current components contained in the modulation drive signal are equal to the sampling frequency.

5. The liquid ejecting apparatus according to claim 1, wherein a period of the drive signal is approximately equal to an integer multiple of a natural vibration period of the pressure chamber.

6. The liquid ejecting apparatus according to claim 1, wherein among alternating current components contained in the modulation drive signal, a frequency of an alternating current component which is most frequently contained is approximately equal to an integer multiple of a natural vibration frequency of the piezoelectric element.

7. The liquid ejecting apparatus according to claim 1, wherein the piezoelectric element transits to a normal state in which a predetermined voltage is applied, an expansion state causing a volume of the pressure chamber to expand, an expansion holding state causing the expanded volume of the pressure chamber to be kept, a contraction state causing the volume of the pressure chamber to contract, and a contraction hold state causing the contracted volume of the pressure chamber to be kept, in order, so as to eject droplets from the nozzle opening portion, and wherein a sum of the periods of the alternating current components contained in the modulation drive signal used for application of the drive signal to the piezoelectric element in the contracted state and the contraction hold state is approximately equal to the natural vibration period of the pressure chamber.

8. A liquid ejecting method comprising:

generating a reference drive signal;

modulating the reference drive signal to generate a modulation reference drive signal;

amplifying the modulation reference drive signal using switching elements to generate a modulation drive signal;

converting the modulation drive signal to a drive signal; and causing deformation of a piezoelectric element in response to the drive signal, and ejecting a liquid from a nozzle opening portion that communicates with a pressure chamber that expands or contracts due to the deformation of the piezoelectric element, wherein periods of alternating current components contained in the modulation drive signal is shorter than a duration of a maximum voltage or a minimum voltage contained in the reference drive signal, and is longer than a total time of turn-on delay times and turn-off delay times of the switching elements.

9. The liquid ejecting method according to claim 8, wherein a period of the drive signal is approximately equal to an integer multiple of a natural vibration period of the pressure chamber.

* * * * *